US006224422B1

(12) United States Patent
Zhu et al.

(10) Patent No.: US 6,224,422 B1
(45) Date of Patent: May 1, 2001

(54) ELECTRICAL CONNECTOR

(75) Inventors: ZiQiang Zhu; Zhonghua Yao; Jian Qiang Zhang, all of Kun San (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/443,064

(22) Filed: Nov. 18, 1999

(30) Foreign Application Priority Data

Aug. 17, 1999 (TW) ..... 88213957

(51) Int. Cl.[7] ..... H01R 13/648
(52) U.S. Cl. ..... 439/607
(58) Field of Search ..... 439/607, 609

(56) References Cited

U.S. PATENT DOCUMENTS 5,288,248 * 2/1994 Chen ..... 439/609
5,637,015 * 6/1997 Tan et al. ..... 439/609
5,980,320 * 11/1999 Slack et al. ..... 439/607
6,007,381 * 12/1999 Ando et al. ..... 439/607

* cited by examiner

*Primary Examiner*—Gary F. Paumen
(74) *Attorney, Agent, or Firm*—Wei Te Chung

(57) ABSTRACT

An electrical connector comprises an insulative housing, a front shell and a rear shell. The insulative housing defines a plurality of passageways for receiving terminals. A plurality of resilient strips stamped from opposite walls of the front shell press against an inserted mating connector. A guiding portion is formed on the end of each forward edge of the front shell to guide a mating electrical connector. A rear section of the insulative housing is received in the rear shell and a front section of the insulative housing is received in the receiving opening of the front shell. A pair of tabs on the top rear of the front shell engages with a pair of corresponding first recesses on a top front of the rear shell and a pair of corresponding second recesses defined in the insulative housing. A plurality of latching fingers extending from inserting plates of the front shell engages with corresponding apertures in the rear shell. Thus, the front shell, the rear shell and the insulative housing are reliably locked together and maintain their relative positions by use of multiple interconnecting latches.

1 Claim, 7 Drawing Sheets

ELECTRICAL CONNECTOR

BACKGROUND OF THE INVENTION

The present invention relates to an electrical connector, and particularly to a Universal Serial Bus (USB) connector, which has a front shell and a rear shell fitted together for firmly fixing an insulative housing and which is easily manufactured.

Conventional USB connectors are disclosed in Taiwan Patent Application Nos. 85217217 and 86207971. Referring to FIG. 7, a shield 1 for a USB connector disclosed in Taiwan Patent Application No. 85217217 comprises a mating portion 10 for mating with a mating electrical connector and a receiving opening 11 for receiving an insulative housing. A plurality of tabs 100 are symmetrically stamped inward from the mating portion 10. The tabs 100 press against a shell of the mating electrical connector for retaining the mating electrical connector. The insulative housing is positioned and secured only by the stamped sides 12 of the receiving opening 11. The manufacture and mating precision of the sides 12 influences how firmly the insulative housing will be fixed in the shield. Unreliable fitting results in an increase in product rejections, a decrease in manufacturing output, and increased waste of material.

BRIEF SUMMARY OF THE INVENTION

A main object of the present invention is to provide an electrical connector having a front shell, a rear shell and an insulative housing reliably fixed together.

Another object of the present invention is to provide an easily manufactured electrical connector having a plurality of easily manufactured contacts received in an insulative housing which reliably contacts a mating electrical connector.

An electrical connector according to the present invention comprises an insulative housing, a front shell and a rear shell. The insulative housing consists of a thick rear section, a thin front section depending forward from the rear section. A plurality of latches is disposed on opposite sides of the rear section for engaging with the rear shell. The front shell includes a guiding portion, a rectangular receiving opening enclosed by a pair of side walls, a top wall and a bottom wall for receiving the front section of the insulative housing and engaging with a mating electrical connector, plus a pair of parallel inserting plates depending from rear edges of the side walls and spaced a distance apart from each other, forming latching fingers on rear edges thereof. Each side wall of the front shell defines a plurality of strips for contacting a mating electrical connector. The unitarily stamped rear shell includes a top wall, a pair of side walls and a rear wall, and the rear section of the insulative housing received therein. Each side wall cooperates with the corresponding inserting plate of the front shell and defines a plurality of latching holes for engaging with the latches of the insulative housing. The rear wall of the rear shell defines a plurality of apertures at opposite edges adjacent the side walls for receiving the latching fingers of the front shell. A pair of latching tongues bends and extends downward from bottom ends of the side walls for mounting to a printed circuit board. The insulative housing, the front shell and the rear shell are reliably fixed together by latches on the housing and latches and tabs on the front shell.

Other objects, advantages and novel features of the invention will become more apparent from the following detailed description when taken in conjunction with the accompanying drawings.

DETAILED DESCRIPTION OF THE INVENTION

Figure 1:
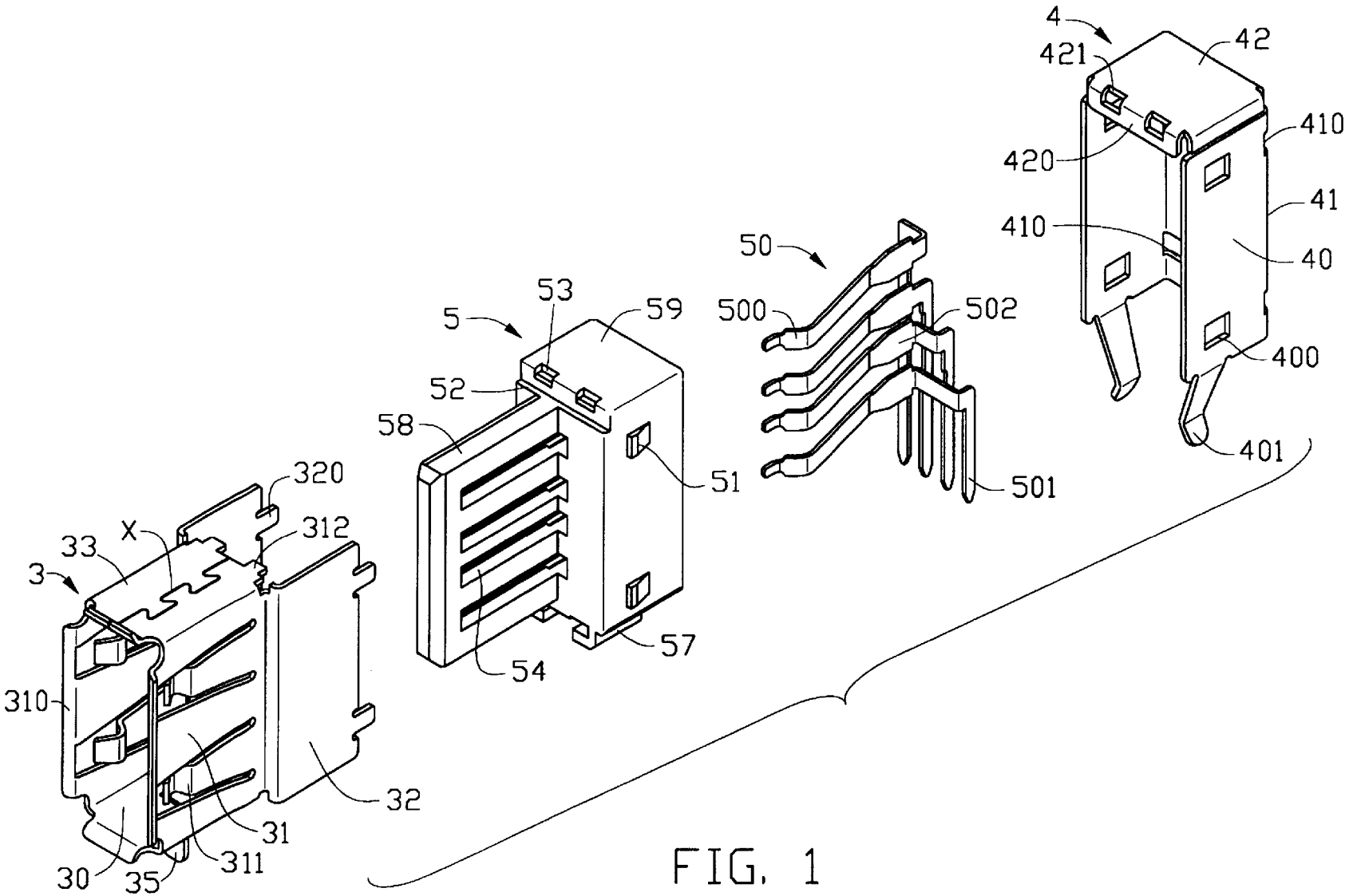
FIG. 1 is an exploded view of an electrical connector of the present invention.
Figure 2:
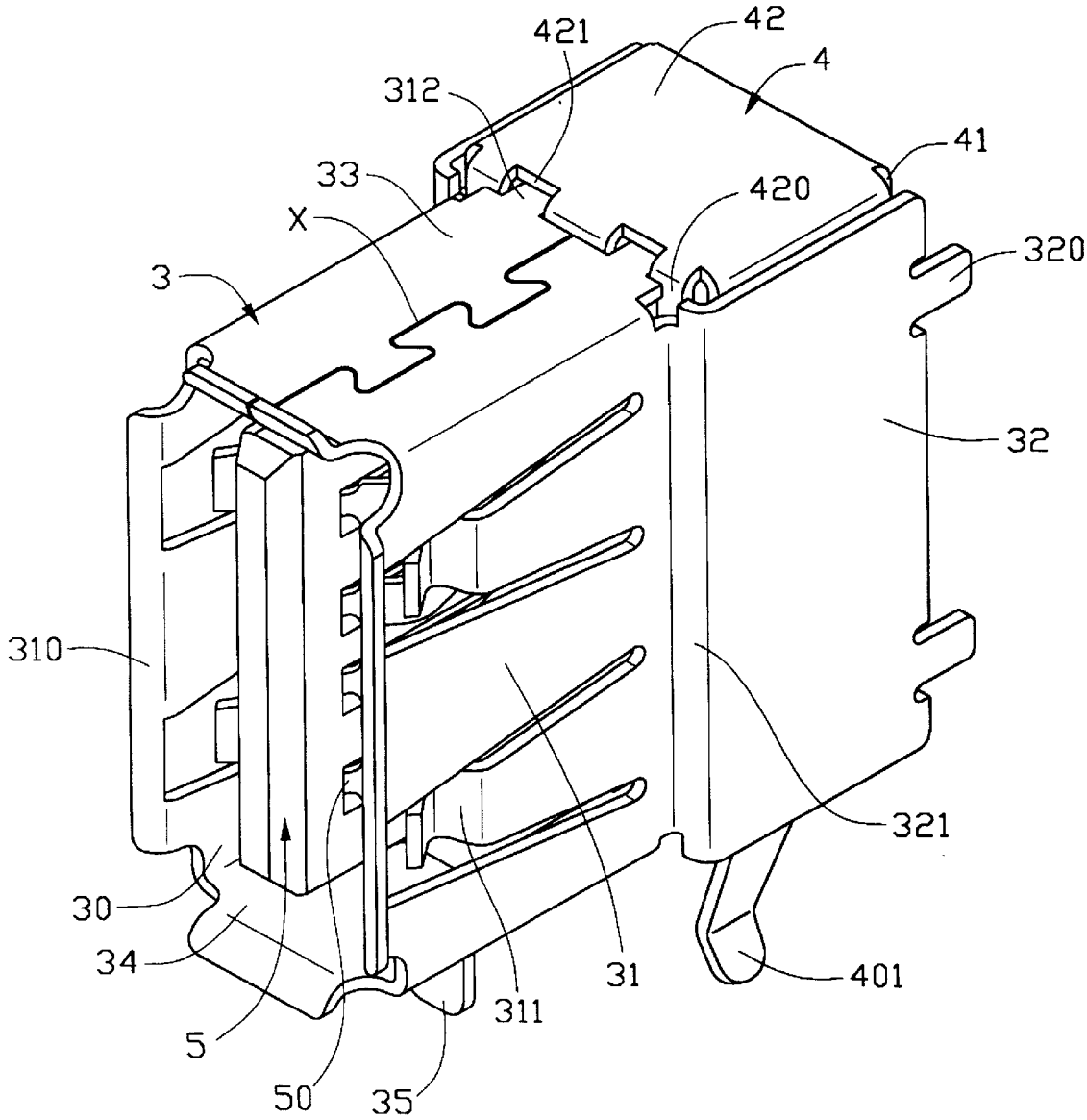
FIG. 2 is an assembled view of FIG. 1.

Referring to FIGS. 1 and 2, an electrical connector of the present invention comprises a rectangular front shell 3, a rear shell 4, an insulative housing 5 and four terminals 50. The front shell 3 includes a receiving opening 30 enclosed by a pair of side walls 31, a top wall 33 and a bottom wall 34. A guiding portion 310 has four parts respectively extending outward from forward edges of the side walls 31, the top wall 33 and the bottom wall 34 for guiding a mating electrical connector into the receiving opening 30. A plurality of strips 311 is stampingly formed in the side walls 31 with a curved end, whereby the resilient strips 311 press against a mating electrical connector making reliable contact and enduring many cycles. A pair of tabs 312 extends rearward from a rear edge of the top wall. A pair of parallel inserting plates 32 extends from a rear edge of each side wall 31, an inclined portion 321 forming the transition between the side walls 31 and the corresponding inserting plates 32. A pair of latching fingers 320 extends rearwardly from a rear edge of each inserting plate 32. A first standoff 35 bends and depends downward from the bottom wall 34.

The rear shell 4 unitarily formed includes a top wall 42 and a pair of side walls 40. A flange 420 depends downward from a front edge of the top wall 42, and a pair of first recesses 421 is defined therein. A pair of apertures 410 is defined at each of opposite edges of the rear wall 41 and adjacent the side walls 40 of the rear shell 4, and correspondingly receiving the latching fingers 320 of the inserting plates 32 of the front shell 3. The side walls 40 define a plurality of latching holes 400 therein and cooperate with the inserting plates 32 of the front shell 3. A pair of latching tongues 401 substantially L-shaped bends and extends from a bottom edge of the side walls 40, respectively. The latching tongues 401 tightly secure the electrical connector to a printed circuit board and facilitate stamping manufacture.

Referring to FIG. 1, the insulative housing 5 consists of a thick rear section 59 and a thin front section 58 extending forward from the rear section 59. Four passageways 54 are defined in the front section 58 for receiving four terminals 50. A plurality of latches 51 disposed on each of opposite sides of the rear section 59 is adapted for mating with the latching holes 400 in the rear shell 4. A step 52 is formed between the front section 58 and the rear section 59 for mating with the flange 420 of the rear shell 4. A pair of second recesses 53 defined in a top front edge of the rear section 59 adjacent the front section 58 corresponds to the first recesses 421 in the rear shell 4 and the tabs 312 of the front shell 3. The rear section 59 has a pair of second standoffs 57 on a bottom surface thereof to fit against the; front shell 3. Each terminal 50 comprises a signal contact 500 at one end, a soldering tail 501 at an opposite end and a retaining portion 502 therebetween adjacent the signal contact 500. The signal contacts 500 received in the passageways 54 mate with the contacts of a mating electrical connector. The retaining portions 502 are substantially planar and formed to secure the terminals 50 in the passageways 54. The soldering tails 501 extends from an end of the retaining portions 502.

Figure 3:
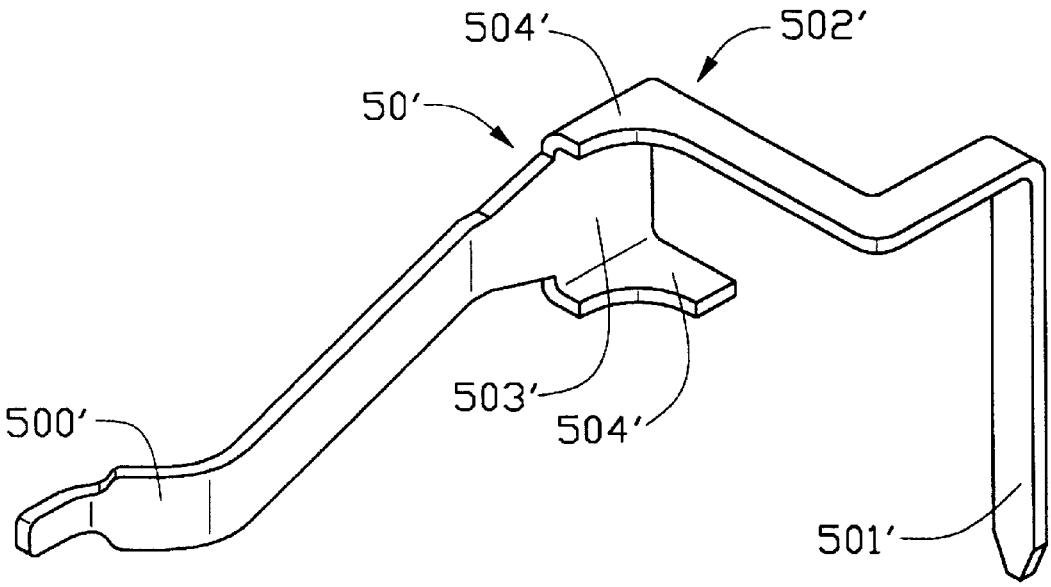
FIG. 3 is a perspective view of a terminal of a second embodiment of the present invention.

A second embodiment of a terminal is illustrated in FIG. 3. Each retaining portion 502' contains a body 503' and two legs 504' depending from a top and bottom edge of the body 503', perpendicular to and in the same direction from the body 503'. Furthermore, each soldering tail 501' extends from an end of one leg 504' of the retaining portion 502' to simplify the second forming thereof.

During assembly, first the terminals 50 are received in the passageways 54 of the insulative housing 5. The insulative housing 5 is inserted into the as rear shell 4, the latches 51 on the insulative housing 5 locking with the latching holes 400 in the rear shell 4, and the flange 420 of the rear shell 4 mating with the step 52 of the insulative housing 5. Then, the front section 58 of the insulative housing 5 is inserted into the receiving opening 30 of the front shell 3. The rear section 59 of the insulative housing 5 and the rear shell 4 are received between the inserting plates 32. The tabs 312 of the front shell 3 are inserted into the first recesses 421 in the rear shell 4 and the second recesses 53 in the insulative housing 5. Moreover, the latching fingers 320 of the front shell 3 are bent inward and inserted into the apertures 410 in the rear shell 4 locking the front shell 3 to the rear shell 4 and the insulative housing 5.

The front shell 3 and the rear shell 4 are manufactured separately to meet different needs. The front shell 3 is unitarily stamped and then folded with a junction seam X defined in the top wall 33. The seam X can alternatively be defined in a side wall 31 to facilitate a stamping or a molding process if it increases the efficiency of manufacturing of the front shell 3.

Figure 4:
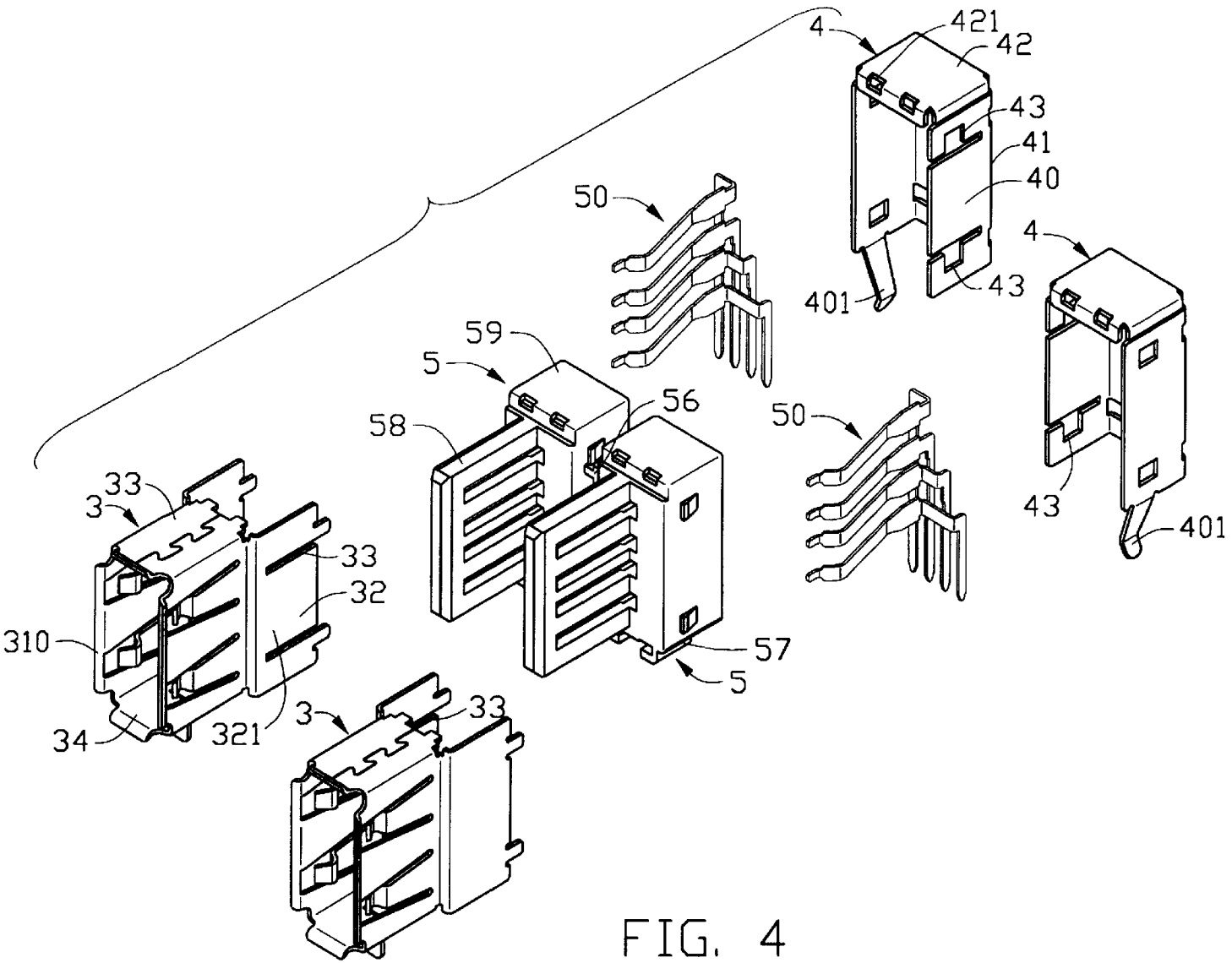
FIG. 4 is an exploded view of a second embodiment of the present invention.
Figure 5:
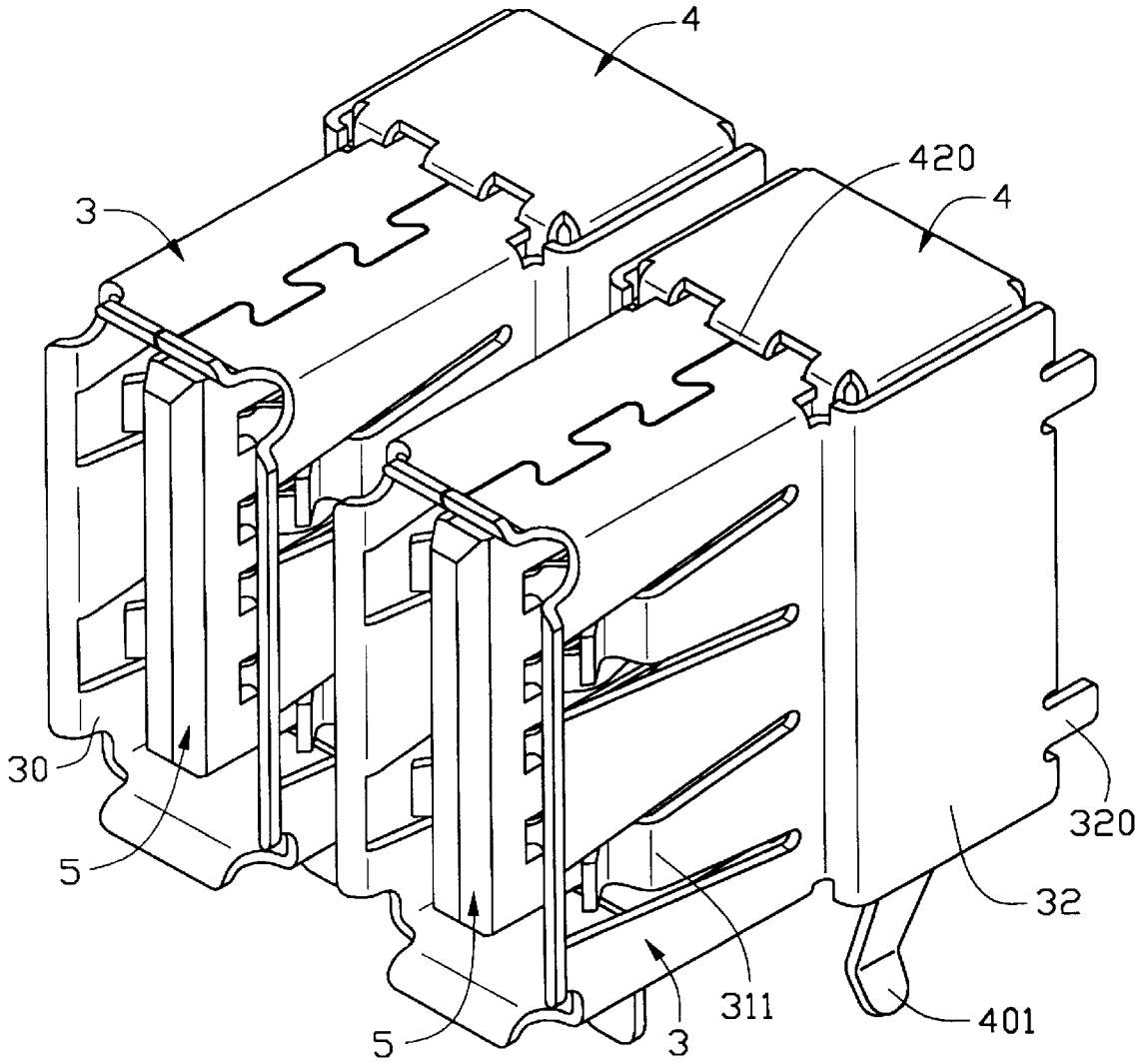
FIG. 5 is an assembled view of FIG. 4.
Figure 6:
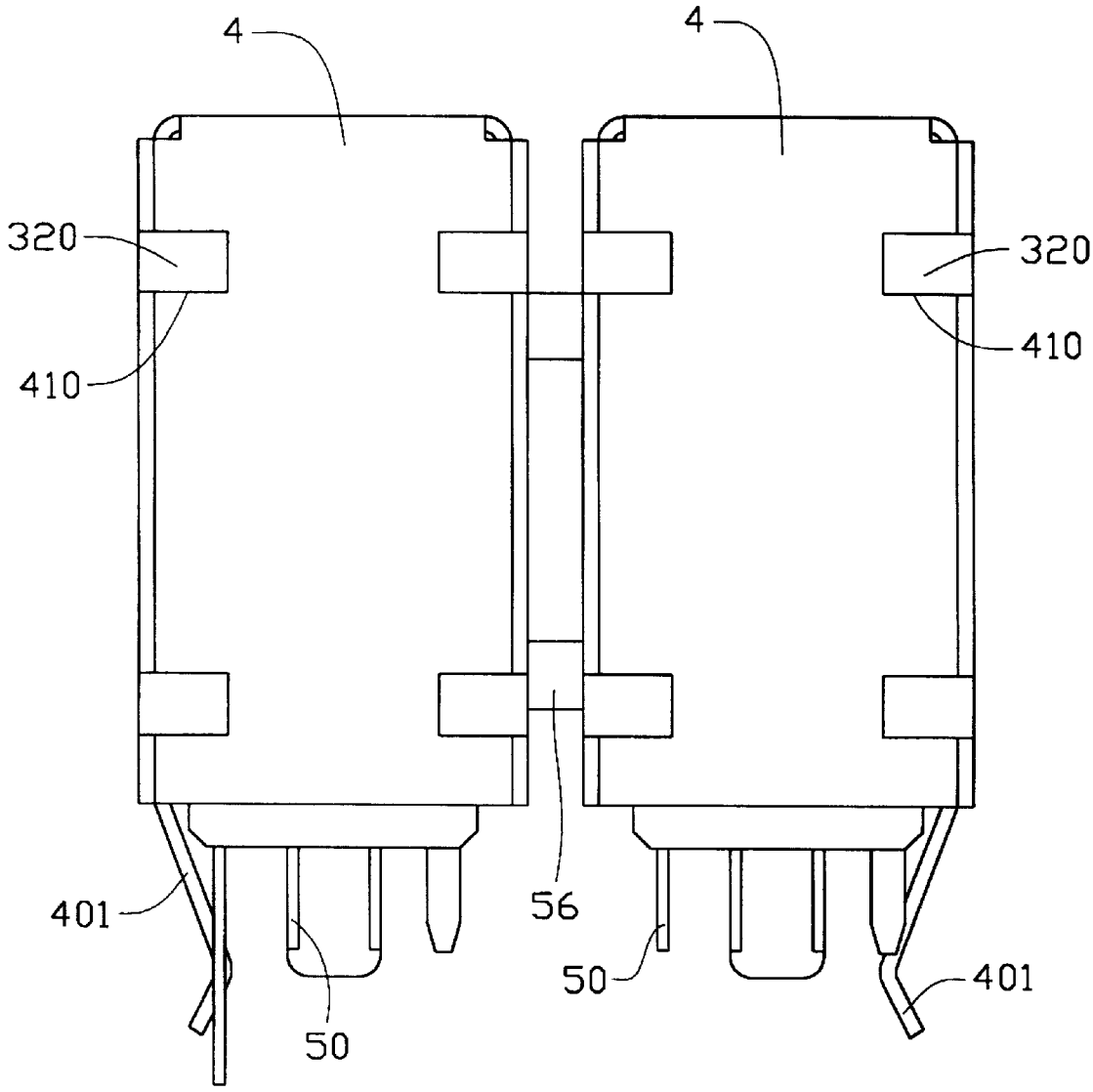
FIG. 6 is a rear view of FIG. 4.
Figure 7:
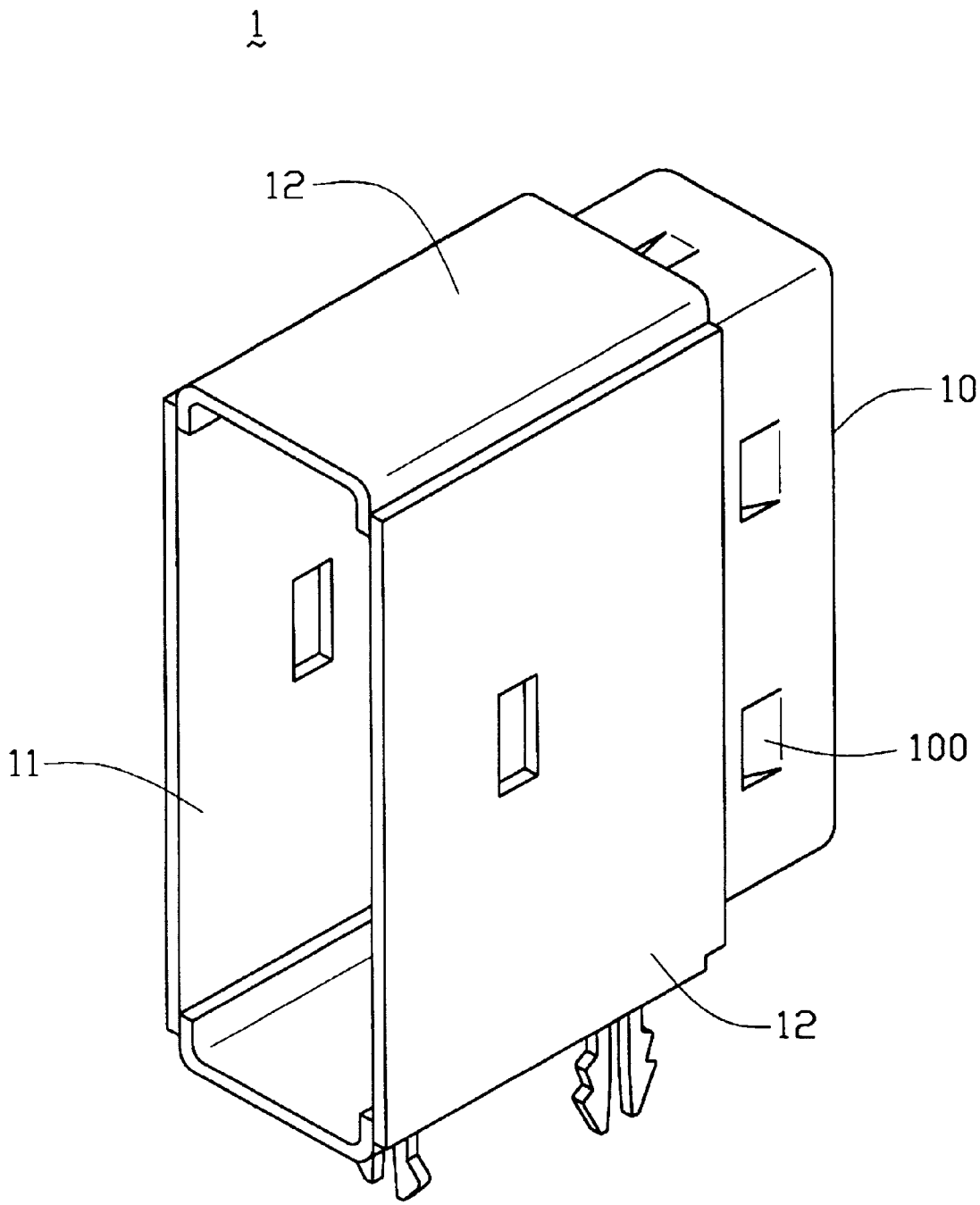
FIG. 7 (PRIOR ART)
FIG. 7 is a perspective view of a conventional electrical connector.

FIGS. 4, 5 and 6 show a second embodiment of the present invention. The first and second embodiments are similar in basic structure. Therefore, like numerals are used in FIGS. 4, 5 and 6 to designate like components of FIGS. 1 and 2 which correspond to those of FIGS. 4, 5 and 6. Referring to FIGS. 4, 5 and 6, a pair of cross members 56 is utilized to link the two rear sections 59 of the insulative housings 5. Accordingly, each rear shell 4 defines a pair of T-shaped slots 43 in the side walls 40, and each front shell 3 defines a pair of elongate slots 33 in the inserting plates 32. Furthermore, a pair of latching tongues 401 respectively extends from the opposite outer side walls 40 of the rear shells 4 of the two electrical connectors to facilitate mounting on the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing including a front section defining a plurality of passageways thereon and a rear section having a plurality of latches formed on opposite sides thereof;

a plurality of terminals received in the passageways of the insulative housing, each terminal including a signal contact, a soldering tail and a retaining portion between the signal contact and the soldering tail;

a one-piece front shell including a bottom wall, a top wall and a pair of side walls enclosing a receiving opening for receiving the front section of the insulative housing therein and a pair of inserting plates respectively extending rearward from-the side walls, each inserting plate forming a plurality of latching fingers at a rear edge thereof; and a one-piece formed rear shell including a top wall, a pair of side walls and a rear wall and receiving the rear section of the insulative housing, a pair of latching tongues extending downward from the side walls for mounting to a printed circuit board, each side wall engaging with a corresponding inserting plate of the front shell and defining a plurality of latching holes for engaging with the latches of the insulative housing, the rear wall defining a plurality of apertures for receiving the latching fingers of the front shell;

wherein the front shell has a guiding portion, the guiding portion having four parts respectively extending outward from edges of the side walls, the top wall and the bottom wall of the front shell for guiding a mating electrical connector into the receiving opening;

wherein a plurality of strips is formed by stamping in the side walls of the front shell, each strip having a curved end for pressing against a mating electrical connector;

wherein a plurality of tabs extends from a rear edge of the top wall of the front shell, a flange depends downwardly from the top wall of the rear shell with a plurality of first recesses corresponding to the tabs of the front shell defined therein, and a step is formed between the front section and the rear section of the insulative housing for mating with the flange of the rear shell;

wherein a plurality of second recesses is defined at an edge of the step of the insulative housing and cooperates with the first recesses of the rear shell for receiving the tabs of the front shell;

wherein the retaining portion of each terminal is substantially planar and each soldering tail extends from an end of the retaining portions;

wherein the retaining portion of each terminal comprises a body and two legs depending from top and bottom edges of the body perpendicular to the body, each soldering tail extending from an end of one leg of the retaining portion.

* * * * *